US005327332A

United States Patent [19]

Hafemeister

[11] Patent Number: 5,327,332

[45] Date of Patent: Jul. 5, 1994

[54] DECORATIVE LIGHT SOCKET EXTENSION

[76] Inventor: Beverly J. Hafemeister, 1192 Goss Ave., Menasha, Wis. 54952

[21] Appl. No.: 53,667

[22] Filed: Apr. 29, 1993

[51] Int. Cl.[5] ..... F21P 1/02; F21V 35/00

[52] U.S. Cl. ..... 362/392; 362/810

[58] Field of Search ..... 362/392, 810, 806, 405, 362/406, 447, 393

[56] References Cited

U.S. PATENT DOCUMENTS

| | | | |
|---|---|---|---|
| D. 86,130 | 2/1932 | Littwin | 362/392 |
| 830,708 | 9/1906 | Goehst | 362/392 |
| 1,861,360 | 5/1932 | Rebl | 362/392 |
| 1,954,756 | 4/1934 | Kidston et al. | 362/392 |
| 1,955,042 | 4/1934 | Work | 362/392 |
| 2,032,451 | 3/1936 | Tighe | 362/392 |
| 2,726,322 | 12/1955 | Alperin et al. | 362/292 |
| 4,590,545 | 5/1986 | Scheer | 362/810 |

FOREIGN PATENT DOCUMENTS 354037 8/1931 United Kingdom .

*Primary Examiner*—James C. Yeung
*Attorney, Agent, or Firm*—Richard C. Litman

[57] ABSTRACT

An extension for installation in an existing incandescent electric light socket has an appearance resembling that of a candlestick, and is particularly adaptable to use with incandescent bulbs having a flame-like appearance. The extension includes a base portion formed to cooperate with a light bulb socket, and an electrical socket in the upper end formed to cooperate with a light bulb having a base of the same size and configuration as that of the base of the extension. Thus, a light bulb may be removed from a socket and installed in the socket of the extension, and the extension installed directly into the socket from which the bulb was removed. The wider outside dimension of the upper socket relative to the lower base is camouflaged by a wider upper portion of the body of the extension, having an appearance resembling that of melted wax from a partially burned candle. The extension is adaptable to various sizes and configurations of light bulbs and sockets, including threaded sockets and bases and "plug-in" type sockets and bases as used with miniature "cool light" type bulbs, and the body portion may be formed of various materials, including new or recycled plastics in various colors.

15 Claims, 2 Drawing Sheets

DECORATIVE LIGHT SOCKET EXTENSION

FIELD OF THE INVENTION

The present invention relates generally to illumination by means of incandescent electrical lighting systems, and more specifically to an extension device which is adaptable to various types of electric light sockets and which provides an appearance simulating a candle stick.

BACKGROUND OF THE INVENTION

The use of electrical power for illumination is nearly universal wherever electrical power is available. When electrical illumination was first established, little or no thought was given to providing an appearance simulating existing light sources (e.g., candles). In fact, it was considered desirable to provide an appearance unlike that of earlier non-electrical types of illumination for various reasons.

In more recent times, incandescent light bulb manufacturers have begun to provide more decorative bulbs, in some cases simulating the appearance of a candle or other small flame. However, the installation of such bulbs in a standard light fixture results in a juxtaposition of appearances, as the flame-like appearance of such a special bulb is out of place in a light fixture not specially adapted for such bulbs.

Additionally, in many cases where decorative lighting is employed (e.g., Christmas trees and other decorations), the bulbs are much too close to other articles which may be damaged by heat or may even be ignited by the heated bulb. While smaller and cooler operating incandescent bulbs have been developed, in many cases such light fixtures are constructed for larger and hotter light bulbs to provide more light and smaller bulbs cannot be practically adapted. While extensions installable within a light socket are known which remove the bulb from the vicinity of the original base or socket, the extensions are generally relatively unornamented cylindrical devices which are constructed to adapt a smaller, decorative light bulb to a larger socket.

The need arises for an extension for use with a light bulb having a decorative, flame-like appearance, which extension is adaptable to both the base of the bulb and a cooperating socket of a light fixture. The extension should provide for the concealment of the upper socket and provide an overall appearance simulating that of a candle and candle flame when used in combination with such a flame-like incandescent bulb. Moreover, the device must be adaptable for use with various types and sizes of incandescent bulbs and their bases and cooperating light fixture sockets.

DESCRIPTION OF THE PRIOR ART

U.S. Pat. No. D-86,130 issued to Samuel Littwin on Feb. 2, 1932 discloses a Christmas Candle or Similar Article. The design appears to be a free standing unit having a relatively wide base and an integral light bulb. No disclosure is made of any structure enabling the fitting of a bulb into a separate extension, nor the fitting of an extension into a cooperating socket or any other structural features.

U.S. Pat. No. 830,708 issued to John H. Goehst on Sep. 11, 1906 discloses a Combined Candle Base And Socket For Miniature Electric Lamps. The base of the device threads into a larger socket than the socket provided at the top of the device for the bulb. No means is disclosed to provide for a socket at the top of the device which is of equal diameter to that of the socket into which the device is inserted. Moreover, the device is solid, with two separate passages for separate electrical wiring through the solid core.

U.S. Pat. No. 1,861,360 issued to Carl Rebl on May 31, 1932 discloses a Lamp having a hollow translucent cylindrical base with two linear filament incandescent bulbs in series therein. A third incandescent bulb is installed in the top of the device and is in series with the two bulbs within the device. The three bulbs in series would require specialized bulbs due to the resistance of the series circuit, and moreover the threaded base of the uppermost bulb is of a smaller diameter than the base of the device. Either a special socket must be provided for the base of the lamp device, or a special bulb having a smaller than standard socket must be provided for the top socket, if the base is of standard size.

U.S. Pat. No. 1,955,042 issued to Shirley A. Work on Apr. 17, 1934 discloses a Light Structure in which an incandescent bulb is concealed within the upper portion and is used to illuminate a separate translucent flame-like upper element. The base of the device and the base of the bulb within the upper portion of the device are of different diameters, the upper bulb base being smaller.

U.S. Pat. No. 2,032,451 issued to Edward A. Tighe on Mar. 3, 1936 discloses an Electric Candle similar to the Work device discussed immediately above. A bulb having a base of smaller diameter than the base of the device is permanently installed in the top of the device, and a translucent shell is used to surround the bulb and the remaining portion of the device. The bulb cannot be removed for replacement without destroying the device.

Finally, British Patent No. 354,037 to Maurice Solomon and Frank Winstanley and published on Aug. 27, 1931, discloses Electric Candle Lamps having a base of one size and type and adapted to receive a bulb having a different type of base and a smaller size. As with each of the patents discussed above, no means is provided for the installation in the upper portion, of a bulb having a base of equal diameter and type as that of the base of the device.

None of the above noted patents, taken either singly or in combination, are seen to disclose the specific arrangement of concepts disclosed by the present invention.

SUMMARY OF THE INVENTION

By the present invention, an improved decorative light socket extension is disclosed.

Accordingly, one of the objects of the present invention is to provide an improved light socket extension which provides an appearance simulating a candlestick.

Another of the objects of the present invention is to provide an improved light socket extension which includes an uppermost electrical socket of equal size and type to the socket into which the base of the device is adapted to fit.

Yet another of the objects of the present invention is to provide an improved light socket extension which includes means for the concealment of the uppermost socket.

Still another of the objects of the present invention is to provide an improved light socket extension which may be constructed to fit a variety of different sizes and types of incandescent light bulbs and in each case having a base formed to fit a base which may cooperate with the specific type and size of bulb.

A further object of the present invention is to provide an improved electrical light extension, the body of which may be formed of a variety of materials, including (but not limited to) new and recycled plastics.

An additional object of the present invention is to provide an improved electrical light extension which includes a substantially hollow body portion, providing for ease of installation of wiring and other components.

Another object of the present invention is to provide an improved electrical light extension which may be formed in a variety of colors, sizes and shapes simulating the colors, sizes and shapes of candlesticks.

A final object of the present invention is to provide an improved electrical light extension for the purposes described which is inexpensive, dependable and fully effective in accomplishing its intended purpose.

With these and other objects in view which will more readily appear as the nature of the invention is better understood, the invention consists in the novel combination and arrangement of parts hereinafter more fully described, illustrated and claimed with reference being made to the attached drawings.

BRIEF DESCRIPTION OF THE DRAWINGS

Similar reference characters denote corresponding features consistently throughout the several figures of the attached drawings.

DETAILED DESCRIPTION OF THE PREFERRED EMBODIMENTS

Figure 1:
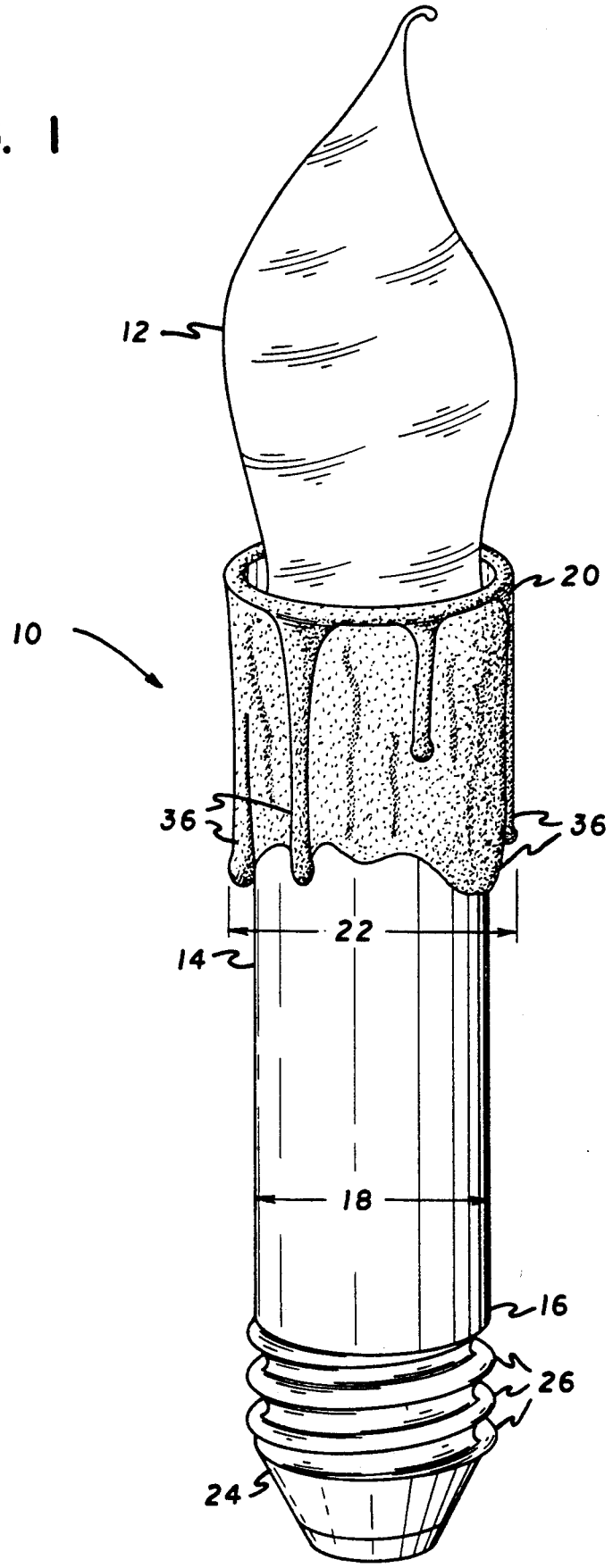
FIG. 1 is a perspective view of one embodiment of the present invention, showing its external features and arrangement of components.

Referring now particularly to FIG. 1 of the drawings, the present invention will be seen to relate to an extension 10 particularly for use with an incandescent electrical light bulb 12 having a flame-like appearance, such as the bulb 12 of FIG. 1. Such bulbs 12 are generally formed with a relatively wide central portion which tapers upwardly to a relatively thin and pointed upper tip to simulate the appearance of a rising flame due to convection. Extension 10 provides further realism with its candlestick-like appearance, and may be used in any socket in which the base of bulb 12 may be accepted.

Figure 3:
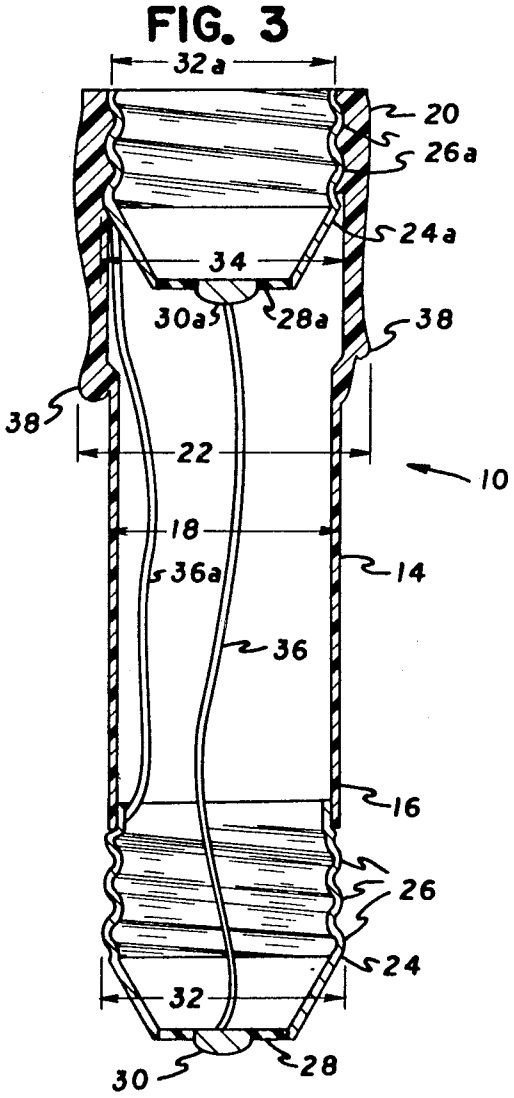
FIG. 3 is a side view in section of the embodiment of FIG. 1, showing the arrangement of internal components.

Extension 10 includes a hollow, generally cylindrical and electrically insulating shell or body 14 having a lower end portion 16 with a lower and main body diameter 18, and an upper end portion 20 with an upper end diameter 22 which is larger than the main and lower body diameter 18, for reasons which will be discussed further below. An electrically conductive base portion 24 is affixed to the lower end 16 of the main body shell 14. Base portion 24 may include threads 26 providing for the installation of extension 10 into a cooperating socket, or may be otherwise configured for such installation. A concentric electrically insulating portion 28 (FIG. 3) is provided at the bottom of the base portion 24, with a separate electrically conductive tip portion 30 in the center thereof, with the electrically insulating portion 28 providing electrical separation between the base portion 24 and the tip portion 30 in the manner of a similarly configured light bulb base.

The upper end 20 of extension 10 encloses and contains an electrically conductive upper socket portion **24*a* (FIG. 3), which may include threads 26*a* in the manner of threads 26 of base portion 24 to cooperate with a like configured light bulb base, or may be otherwise configured. Upper socket portion 24*a* also includes a concentric electrically insulating portion 28*a* and an electrically conductive central portion 30*a*, also in the manner of the respective components 28 and 30 of base portion 24. It is important to note that the outside diameter 32 of base portion 24 is equal to the inside diameter 32*a* of the upper socket 24*a*. This provision of equal outside and inside diameters 32 and 32*a* respectively for the lower base portion 24 and the upper socket 24*a*, allows a bulb base having a size and configuration equal to that of the base portion 24, to be installed directly within the upper socket 24*a* of extension 10. In other words, a light bulb may be removed from an existing socket and installed directly into the upper socket 24*a* of extension 10, and extension 10 may then be installed directly into the existing socket from which the light bulb was removed for installation into extension 10**.

As the outside diameter 32 of base portion 24 is essentially equal to the outside diameter 18 of the main portion of the cylindrical shell or body 14 of extension 10 and the inside diameter **32*a* of the upper socket 24*a*, it will be seen that the outside diameter 34 of the upper socket 24*a* will extend slightly beyond the outside diameter 18 of the cylindrical body 14 of extension 10. Accordingly, provision must be made to enclose the electrically conductive shell of the upper socket 24*a* in order to preclude any electrical hazard. The present invention provides for this with an electrically insulating upper end portion 20 having an outside diameter 22 larger than the outside diameter 34 of the upper socket 24*a* and the outside diameter 18 of the main portion of the cylindrical body shell 14. As the present invention preferably provides a candlestick-like appearance, and candles are generally molded in cylindrical form or dipped to produce a tapered upper portion, the enlargement of the upper diameter 22 may be camouflaged by providing it with an irregular portion having the appearance of melted wax which has run partially down the sides of the candlestick. This simulated melted wax 38 thus provides a decorative, pleasing and realistic appearance for extension 10, in keeping with the type of light bulb 12 preferably used in combination with the present invention, and also provides the thickening or increase in diameter 22 required to completely contain an upper socket 24*a* sized to cooperate with a light bulb having a base of equal size to the base 24 of extension 10**.

In order to provide electrical power to the upper socket **24*a* of extension 10, a first electrical connector 36 is connected between the inside of the conductive tip 30 within the base 24 and the conductive tip 30*a* within the upper socket 24*a*. A second electrical connector 36*a* is connected between the base portion 24 and the upper socket 24*a* to complete the circuit. Thus, when extension 10 is electrically secured within a cooperating socket by means of base 24, a light bulb within the upper socket 24*a* receives electrical power by means of the electrically conductive tip 30 in the base 24, through the first conductor 36 to the tip 30*a* of socket 24*a* and thence through the bulb filament. The bulb also cooperates electrically as well as mechanically with the upper socket 24*a*, which provides a second electrical path to the base 24 by means of the interconnecting second conductor 36***a*.

Figure 2:
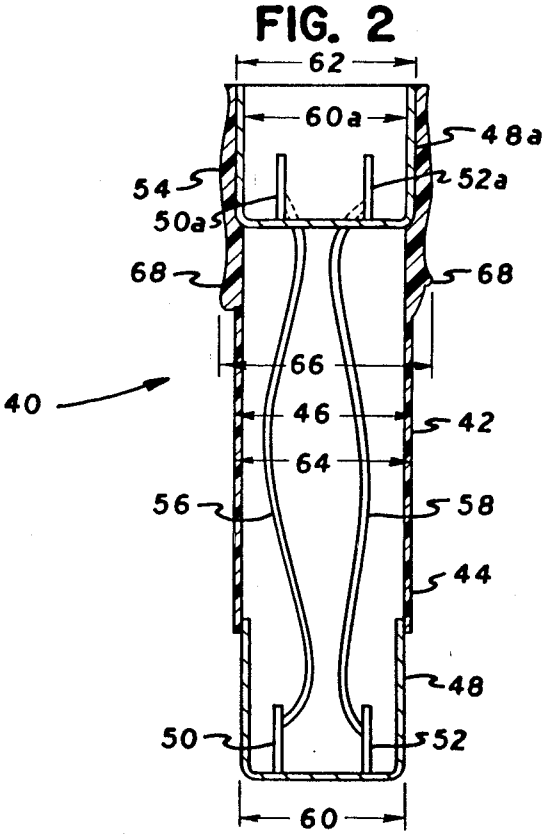
FIG. 2 is an enlarged side view in section of an alternate embodiment, providing for use with miniature sockets and cooperating miniature bulbs.

FIG. 2 provides a cross sectional view of a second embodiment 40 of the present invention. Extension 40 is formed to cooperate with incandescent bulbs having a different base structure than the generally cylindrical base shown in FIGS. 1 and 2 and described above. Miniature light bulbs having an output generally of some four to seven watts, are generally equipped with bases which provide for the direct insertion or "plugging in" of the bulb into a cooperating socket. The bulbs are generally equipped with at least two parallel external contacts which extend at least partially up the side of the base of the bulb. Thus, cooperating sockets are equipped with two parallel and spaced apart electrical conductors to make contact with the bulb contacts when such a miniature bulb is inserted into a cooperating socket. Many such miniature bulbs also have the additional advantage of operating at a relatively cool temperature, providing additional safety when an extension or extensions 40 are used to trim a Christmas tree, for example.

Extension 40 will be seen to have many components which are similar in function to those of extension 10, such as an electrically insulating and generally cylindrical shell or body portion 42 having a lower end portion 44 with a lower and main body outside diameter 46. A base portion 48 is provided and sized to cooperate with a socket for such miniature bulbs. Base portion 48 contains first and second parallel and spaced apart electrical contacts 50 and 52, positioned to cooperate with the electrical contacts in such miniature bulbs as discussed above.

The upper portion 54 of extension 40 includes a socket 48*a* similar in configuration to the base 48. Socket 48*a* contains parallel and spaced apart first and second electrical contacts 50*a* and 52*a*, in the manner of the electrical contacts 50 and 52 of the base portion 48 and configured to cooperate electrically with a miniature bulb. First electrical contacts 50 and 50*a* are electrically connected by a first electrical conductor 56, while second electrical contacts 52 and 52*a* are electrically connected by a second conductor 58, in the manner of the electrical conductors 36 and 38 of extension 10. However, the upper socket 48*a* is slightly larger than the base 48, with the base 48 having an outside dimension 60 which is equal to the inside dimension 60*a* of the upper socket 48*a* and also equal to the inside diameter of the body portion 42 of extension 40. Thus, the base 48 is of a size and configuration to cooperate with a miniature bulb socket of the size and configuration of the upper socket 48*a* of extension 40, thereby allowing the base of extension 40 to be inserted into a cooperating socket and a bulb sized to cooperate with such a socket to be directly inserted into the upper socket 48*a* of extension 40.

The outside dimension 62 of the upper socket 48*a* is therefore slightly larger than the outside dimension 60 of base 48 and the inside diameter 46 of the main body 42; it will be seen to be approximately equal to the outside diameter 64 of the main body 42. Accordingly, the upper portion 54 of extension 40 must be of a larger outside diameter 66 in order to contain the upper socket 48*a*. This is accomplished by means of the irregular simulated melted wax runoff 68 provided along the upper portion 54 of extension 40, in the manner of the simulated wax runoff 38 of extension 10. Thus, a socket may be provided within the upper end portion of a candlestick-like electrical extension, which socket is sized to accept the base of an incandescent bulb of the same size and configuration as that of the base of the extension, while still providing the required additional electrical insulation and structure at the top of the extension to provide for the socket therein.

Either of the above described embodiments of extensions 10 and 40 may be basically formed of any suitable electrically insulating material, such as plastics of various types, either new or recycled. The electrically conductive components may be formed from any suitable material (e.g., brass or copper), in the manner used conventionally for such components. By molding the cylindrical shell or body portions 14 and 42 of extensions 10 and 40 in various colors, a variety of such extensions may be provided which will be suitable for use in virtually any circumstance where the simulation of a burning candle is desired, such as various lighting fixtures, candelabras, Christmas trees and other holiday decorations and trim, etc.

It is to be understood that the present invention is not limited to the sole embodiments described above, but encompasses any and all embodiments within the scope of the following claims.

I claim:

1. A decorative extension simulating the appearance of a candlestick, comprising:

a hollow, generally cylindrical body portion having a lower end and an upper end;

said lower end fitting over and enveloping an end portion of an electrical base having first and second electrically conductive contacts, with said electrical base extending from said lower end of said body portion and being of a size and configuration to removably fit within and make electrical contact with an electrical socket for an incandescent electric light bulb;

said upper end of said body portion having a larger diameter than said lower end of said body portion and fitting over and completely enveloping the outer surface of an electrical socket therein with said electrical socket having first and second electrically conductive contacts therein, and said electrical socket being of a size and configuration to make electrical contact with an incandescent electric light bulb having a base of equal size and configuration to said electrical base of said lower end of said body portion; and a first electrically conductive connector electrically connected between said first electrically conductive contact of said electrical base and said first electrically conductive contact of said electrical socket, and a second electrically conductive connector electrically connected between said second electrically conductive contact of said electrical base and said second electrically conductive contact of said electrical socket, whereby;

said extension is installed in a cooperating socket for an incandescent electric light bulb by means of said electrical base and an incandescent electric light bulb having a base of like size and configuration to said electrical base of said extension is installed within said electrical socket within said upper end of said extension.

2. The extension of claim 1 wherein:

said electrical base of said extension includes thread means providing for the threadable installation of said electrical base within a cooperating electrical socket with said thread means having a diameter substantially equal to that of said body portion; and said electrical socket within said upper end of said extension includes thread means of identical size and configuration to that of the cooperating electrical socket.

3. The extension of claim 1 wherein:

said electrical base of said extension includes at least two parallel, spaced apart electrical contacts providing for the insertion of said electrical base within a cooperating electrical socket; and said electrical socket within said upper end of said extension includes at least two parallel, spaced apart electrical contacts and is of identical size and configuration to that of the cooperating electrical socket.

4. The extension of claim 1 wherein:

said larger diameter of said upper end of said body portion includes an irregular surface simulating a buildup of melted wax.

5. The extension of claim 1 wherein:

at least said body portion is formed of plastic.

6. The extension of claim 5 wherein:

at least said body portion is formed of new plastic.

7. The extension of claim 5 wherein:

at least said body portion is formed of recycled plastic.

8. In combination with an incandescent electric light bulb including an electrical base having first and second electrically conductive contacts, a decorative extension simulating the appearance of a candlestick, comprising:

a hollow, generally cylindrical body portion having a lower end and an upper end;

said lower end of said extension fitting over and enveloping an end portion of an electrical base having first and second electrically conductive contacts, with said electrical base of said lower end of said extension extending from said lower end of said body portion and being of identical size and configuration to said electrical base of said incandescent electric light bulb;

said upper end of said body portion of said extension having a larger diameter than said lower end of said body portion of said extension and fitting over and completely enveloping the outer surface of an electrical socket therein with said electrical socket having first and second electrically conductive contacts therein, and said electrical socket being of a size and configuration to electrically cooperate with said electrical base of said incandescent electric light bulb; and a first electrically conductive connector electrically connected between said first electrically conductive contact, of said electrical base of said extension and said first electrically conductive contact of said electrical socket of said extension, and a second electrically conductive connector electrically connected between said second electrically conductive contact of said electrical base of said extension and said second electrically conductive contact of said electrical socket of said extension, whereby;

said extension is installed in a cooperating incandescent electric light socket by means of said electrical base of said extension and said incandescent electric light bulb including said base of like size and configuration to said electrical base of said extension is installed within said electrical socket within said upper end of said extension.

9. The extension of claim 8 wherein:

said incandescent bulb is formed with a wide central portion which tapers upwardly to a thin and pointed upper tip, whereby;

the appearance of a rising flame is simulated.

10. The extension of claim 8 wherein:

said electrical base of said extension includes thread means providing for the threadable installation of said electrical base within a cooperating electrical socket with said thread means having a diameter substantially equal to that of said body portion; and said electrical socket within said upper end of said extension includes thread means of identical size and configuration to that of the cooperating electrical socket.

11. The extension of claim 8 wherein:

said electrical base of said extension includes at least two parallel, spaced apart electrical contacts providing for the insertion of said electrical base within a cooperating electrical socket; and said electrical socket within said upper end of said extension includes at least two parallel, spaced apart electrical contacts and is of identical size and configuration to that of the cooperating electrical socket.

12. The extension of claim 8 wherein:

said larger diameter of said upper end of said body portion includes an irregular surface simulating a buildup of melted wax.

13. The extension of claim 8 wherein:

at least said body portion is formed of plastic.

14. The extension of claim 13 wherein:

at least said body portion is formed of new plastic.

15. The extension of claim 13 wherein:

at least said body portion is formed of recycled plastic.

* * * * *